US008006778B2

(12) United States Patent
Wiker et al.

(10) Patent No.: US 8,006,778 B2
(45) Date of Patent: Aug. 30, 2011

(54) HANDHELD POWER TOOL

(75) Inventors: Juergen Wiker, Hangzhou (CN); Joachim Schadow, Dettenhausen (DE); Joerg Maute, Sindelfingen (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 11/761,020

(22) Filed: Jun. 11, 2007

(65) Prior Publication Data

US 2008/0041603 A1 Feb. 21, 2008

(30) Foreign Application Priority Data

Jun. 16, 2006 (DE) ..... 10 2006 027 782

(51) Int. Cl.
*B25D 17/00* (2006.01)

(52) U.S. Cl. ..... 173/162.2; 173/162.1; 173/170; 173/171; 173/210; 173/211

(58) Field of Classification Search ..... 173/162.2, 173/162.1, 170, 171, 210, 211
See application file for complete search history.

(56) References Cited

U.S. PATENT DOCUMENTS

| | | | | | |
|---|---|---|---|---|---|
| 2,656,225 | A * | 10/1953 | Saylor | 403/203 |
| 5,201,146 | A * | 4/1993 | Fushiya | 451/358 |
| 5,692,574 | A * | 12/1997 | Terada | 173/162.2 |
| 5,697,456 | A * | 12/1997 | Radle et al. | 173/162.2 |
| 6,158,772 | A * | 12/2000 | Skudutis | 280/781 |
| 6,318,216 | B1 * | 11/2001 | Eggert et al. | 81/61 |
| 7,076,838 | B2 * | 7/2006 | Meixner | 16/431 |
| 7,204,744 | B2 * | 4/2007 | Lamprecht et al. | 451/357 |
| 7,217,178 | B2 * | 5/2007 | Oki et al. | 451/359 |
| 2005/0224244 | A1 | 10/2005 | Kraenzler et al. | |
| 2006/0086515 | A1 * | 4/2006 | Engelfried | 173/162.2 |
| 2006/0113098 | A1 * | 6/2006 | Inagawa et al. | 173/162.2 |
| 2006/0166613 | A1 * | 7/2006 | Lamprecht et al. | 451/359 |
| 2007/0289763 | A1 * | 12/2007 | Wiker et al. | 173/162.2 |
| 2007/0295521 | A1 * | 12/2007 | Wiker et al. | 173/162.1 |
| 2008/0000665 | A1 * | 1/2008 | Kokinelis et al. | 173/170 |

FOREIGN PATENT DOCUMENTS

| | | | |
|---|---|---|---|
| CN | 1448250 | | 10/2003 |
| DE | 41 24 574 | | 1/1993 |
| DE | 4124574 | * | 1/1993 |
| DE | 195 25 251 | | 1/1996 |
| EP | 1 652 633 | | 5/2006 |
| EP | 1 714 748 | | 10/2006 |
| GB | 1 567 610 | | 5/1980 |
| GB | 2 297 514 | | 8/1996 |
| JP | 62-74564 | | 4/1987 |
| WO | WO 02/38341 | | 5/2002 |
| WO | 03/011532 | | 2/2003 |
| WO | 2004/039541 | | 5/2004 |

* cited by examiner

*Primary Examiner* — Rinaldi I. Rada
*Assistant Examiner* — Michelle Lopez
(74) *Attorney, Agent, or Firm* — Michael J. Striker

(57) ABSTRACT

In a handheld power tool, including a first housing part and a second housing part as well as a damping element between the first housing part and the second housing part, the damping element is connectable to the first housing part and the second housing part, and the handheld power tool further has at least one securing element, which is connectable to the first housing part and the second housing part.

17 Claims, 4 Drawing Sheets

HANDHELD POWER TOOL

CROSS-REFERENCE TO A RELATED APPLICATION

The invention described and claimed hereinbelow is also described in German Patent Application DE 102006027782.1 filed on Jun. 21, 2006. This German Patent Application, whose subject matter is incorporated here by reference, provides the basis for a claim of priority of invention under 35 U.S.C. 119(a)-(d).

BACKGROUND OF THE INVENTION

The invention is based on a handheld power tool.

In work with electric tools, such as right-angle sanders, drills, and drill hammers, more or less severe vibration occurs, which is due among other factors to the imbalance of the masses of the motor, gear, tool inserts, and so forth that rotate at high speed, and to the machining of workpieces. The vibration is transmitted to the user of the electric tool via the handle and cause fatigue in the user's hand. If the user works for long with heavily vibrating electric tools, his health may even be impaired.

In German Patent Disclosure DE 195 25 251 A, a vibrating tool with a vibration insulating ring to insulate the handle against vibration generated by the vibrating tool is described. The tool housing is provided with a protrusion on its back end. By engagement of a stop, located on the handle, with a flange on the protrusion, the handle is connected to the housing in force-locking fashion, with an interstice between them. A rubber ring is located in the interstice between the handle and the housing. A groove open radially inward is provided in the rubber ring, so that the ring is easily deformed when the handle and the housing are displaced relative to one another.

From International Patent Disclosure WO 02/38341 A, a handheld power tool is also known in which a taper that forms a carrier element is integrally molded onto the housing part, on the end remote from the tool mount. The shell housing of the handle fits over the carrier element of the housing part. The housing part and the shell housing are decoupled via a vibration damping unit in the form of an annular gas cushion. The gas cushion is supported radially inward in an annular groove extending over the entire circumference of the carrier element and radially outward in a corresponding second annular groove in the shell housing. The shell housing is secured to the carrier element via a contactless, form-locking connection.

SUMMARY OF THE INVENTION

It is therefore an object of the present invention to provide a handheld power tool of the above mentioned general type, which is a further improvement of the existing handheld power tools.

The handheld power tool of the invention includes a first housing part and a second housing part as well as a damping element between the first housing part and the second housing part, the damping element being connectable to the first housing part and the second housing part. According to the invention, at least one securing element is provided, which is connectable to the first housing part and the second housing part.

Since the damping element makes the connection between the two housing parts, if the damping element is damaged or broken there is the risk that the connection between the housing parts will be damaged and the two housing parts will be disconnected from one another. The securing element serves to assure the connection between the housing parts if the connection by the damping element is no longer adequately assured because of damage or breakage. The securing element can additionally take on the function of a stop, to prevent an overload on the damping element from excessive demands on its elastic properties.

In particular, the first housing part and the second housing part are a motor housing and a handle, respectively. In some handheld power tools, such as right-angle sanders, the housing is constructed of at least two housing parts, which are located one after the other in the longitudinal axis of the handheld power tool and joined together: a rear housing part, the motor housing, for instance of plastic, and a front housing part, the gearbox, for instance of metal. The motor housing receives, among other elements, an electric motor, which via the gear accommodated in the gearbox drives a driven spindle as well as a sanding wheel connected to the driven spindle in a manner fixed against relative rotation. A handle is located at the back on the rear housing part, that is, the motor housing. The terms front and back refer to the working direction of the handheld power tool.

The first and second housing parts may each be in one piece, for instance in the form of a cup, so that the components can be introduced into the housing part from the open end. However, the two housing parts may also be in multiple parts, for instance two parts, for instance being constructed of two half shells that are joined together in the longitudinal axis of the handheld power tool and connected to one another. A combination is also possible, for instance in such a way that the first housing part, for instance a motor housing, is constructed in two parts of two half shells, and the second housing part, such as a handle, is constructed in one piece from a cup-shaped housing.

The first and second housing parts are preferably of plastic, and either the same or different plastics may be used for the two housing parts. The securing element may for instance of metal or plastic.

In a first embodiment, the securing element may be a separate component, which is placed in the housing of the handheld power tool and connected to the first and second housing parts in such a way that it forms a connection between the two housing parts. For instance, the securing element can be secured to the two housing parts either with or without being secured to the damping element. To accomplish vibration damping, the securing element itself has damping or elastic properties. Hence the securing element additionally acts as a damping element. The connection of the securing element to the two housing parts can be done in various ways, for instance in form-locking fashion or by means of screws, rivets, clips, adhesive bonding, welding, hot embossing, or other methods. For instance, it may be integrally molded onto the housing parts by injection molding.

In another embodiment, the securing element is connected to the damping element, and this can in turn be done in various ways. Preferably, the securing element is connected to the damping element in such a way that the securing element is embedded in the damping element. This is comparatively simple to do by injection molding, for instance, for a damping element comprising a thermoplastic elastomer. The securing element is placed in the cavity of the injection mold and sheathed with the thermoplastic elastomer in the integral molding of the damping element.

A combination of the above-described embodiments is also possible, by connecting the securing element both to the housing parts and to the damping element.

The securing element may be formed for instance by struts, wires, or plates. The securing element may also be a net, woven fabric, mesh, knitted fabric, or the like, of metal, plastic or natural material, or a combination of these materials.

In a preferred embodiment, the securing element is embodied such that it additionally acts as a damping element. Preferably, the securing element is a spring element, for instance in the form of a leaf spring.

The first housing part and the second housing part are preferably spaced apart from one another in the longitudinal direction of the handheld power tool. Accordingly, there is an interstice between the two housing parts, which is filled by the damping element. The connection of the two housing parts to one another is done solely via the damping element, so that there is no direct rigid connection between the two housing parts. Vibration can therefore not be transmitted, or can be transmitted only in damped fashion, from one housing part to the other.

The handheld power tool of the invention advantageously has a structurally simple damping element. Since furthermore no form lock between the two housing parts is provided, no specific shaping that would make a form lock between the two housing parts possible is necessary in the peripheral regions of the two housing parts, where they are joined together via the damping element. Because of the structurally simple damping element and the simple shaping of the housing parts, the handheld power tool overall can be produced simply. Despite the simple mode of construction of the handheld power tool, however, effective vibration damping is achieved. The improved vibration properties enhance the user friendliness of the handheld power tool.

The damping properties of the damping element may be varied by means of the material, shape, thickness, and other parameters of the damping element.

The damping element is preferably of an elastic material. Possible elastic materials are for instance elastomers or foams. The damping element may in particular comprise a thermoplastic elastomer.

The damping element is annular or nearly annular, depending on the cross-sectional shape of the two housing parts in their connection region. For instance, the damping element extends all the way around in the interstice between the two housing parts. The damping element may be embodied in profiled fashion, in particular by providing that it forms a radially outward-oriented bead in the interstice between the two housing parts. The damping element may also be profiled in some other way in order to enhance the vibration damping. For instance, the damping element may be provided with channels extending all the way around circumferentially, or it may have a folded structure.

The damping element may be connected to the first and second housing parts in various ways. The connection may be done in form-locking fashion, for instance by means of pegs on the damping element that form an undercut with the housing parts. The connection may also be in force-locking fashion, for instance by means of screws or rivets, or material-locking fashion, such as by adhesive bonding or welding. A combination of one or more of these types of connection is also possible.

In a simple embodiment, the damping element can be connected to the first and second housing parts by injection molding. A damping element comprising a thermoplastic elastomer may be integrally molded directly from the inside onto the two housing parts in a dual-component injection molding process. For instance, the two housing parts comprising a thermoplastic are molded in a first cavity of an injection mold. After the two housing parts have been moved to a second cavity of the same injection tool (or alternatively into a cavity of a second injection tool), the damping element comprising a thermoplastic elastomer is integrally molded onto the housing parts.

Alternatively, the damping element may be produced in a separate method and then integrally molded onto the housing parts by injection molding. This is done by placing the separately produced damping element in the cavity of an injection mold and sheathing it in the molding of the housing parts in such a way that the damping element is solidly joined to the two housing parts. A prefabricated damping element of an elastic material may also be integrally molded in this way onto the housing parts by injection molding. In the connection of the damping element by injection molding, a form lock can additionally be achieved, for instance by providing that the housing parts have beads, ribs, or other kinds of indentations or raised areas that form an undercut, for instance, with the damping element.

The damping element can be attached from the outside to the two housing parts. However, it is also attached from the inside. It can furthermore be attached both from the inside and from the outside. Thus the damping element, for instance comprising elastic material, may be attached in overlapping fashion on the outside and inside to the housing parts, for instance being integrally molded onto them or glued to them.

In one embodiment, at least one retaining element is provided in the first housing part and/or the second housing part, with which retaining element the damping element can be connected. Preferably, at least one retaining element is provided in each of the two housing parts. The retaining elements serve the purpose of securely fastening the damping element to the housing parts. The retaining element may for instance be of metal or plastic, and a plurality of retaining elements may also be of different materials. One retaining element is connected to each of the housing parts. This can be done in various ways, for instance in form-locking fashion or by means of screws, rivets, clips, adhesive bonding, welding, hot embossing, or other processes.

The damping element is in turn connectable to the retaining element, also in various ways. Preferably, the damping element is connected to the retaining elements in such a way that the retaining elements are embedded in the damping element. This is comparatively simple to do, for instance by injection molding. The retaining elements are placed in the cavity of the injection mold and sheathed with the thermoplastic elastomer in the molding of the damping element.

The retaining element may also be embodied such that it additionally takes on the function of a securing element. To that end, a retaining element must be connected not to merely one of the two housing parts but rather to both housing parts, in such a way that the retaining element makes a connection between the housing parts.

The handheld power tool of the invention is for instance a handheld right-angle power sander.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
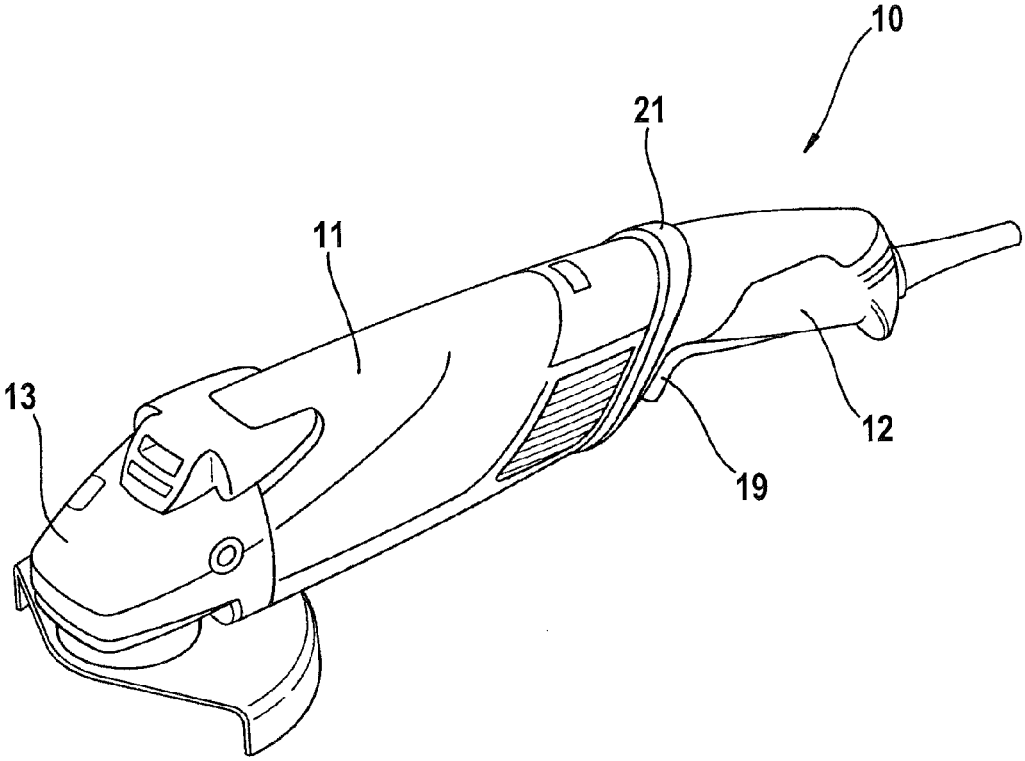
FIG. 1 is a perspective view of one embodiment of a handheld power tool of the invention, with a damping element.

In FIG. 1, a right-angle power sander 10 is shown as an embodiment of a handheld power tool of the invention. The right-angle power sander 10 in the embodiment shown includes three housing parts: a first housing part 11 for receiving an electric motor (not shown), among other elements; a second housing part 12, which is embodied as a handle 15; and a third housing part 13 for receiving a gear (not shown), among other elements. A drive shaft drivable by an electric motor is coupled (not shown) to a driven shaft via a gear, comprising a driving gear wheel and a driven gear wheel. A sanding wheel is located on the driven shaft in a manner fixed against relative rotation (not shown). The electric motor is switched on and off by the user via an ON/OFF switch 19. In the embodiment shown in FIG. 1, the first housing part 11 and the second housing part 12 are of plastic, while the third housing part 13, which is the gearbox, is of metal.

In the region between the first housing part 11 or motor housing and the second housing part 12 or handle, the right-angle power sander 10 has a damping element 21 for vibration-decoupled or vibration-damped connection of the two housing parts 11, 12. As can be seen in FIG. 1 and particularly in the sectional view in FIG. 2, the first housing part 11 and the second housing part 12 are spaced apart from one another in the longitudinal direction of the right-angle power sander 10, so that an interstice 15 in the form of a gap between the first housing part 11 and the second housing part 12 is formed. The damping element 21 fills up the interstice 15, and the connection of the two housing parts 11, 12 to one another is effected solely via the damping element 21, so that there is no direct, rigid connection between the two housing parts 11, 12.

The damping element 21 comprises an elastic material, in particular a thermoplastic elastomer. It is connected to the first and second housing parts 11, 12 by injection molding, in which the damping element 21 is integrally molded from the inside onto the inner walls 14, 16 of the two housing parts 11, 12.

Figure 2:
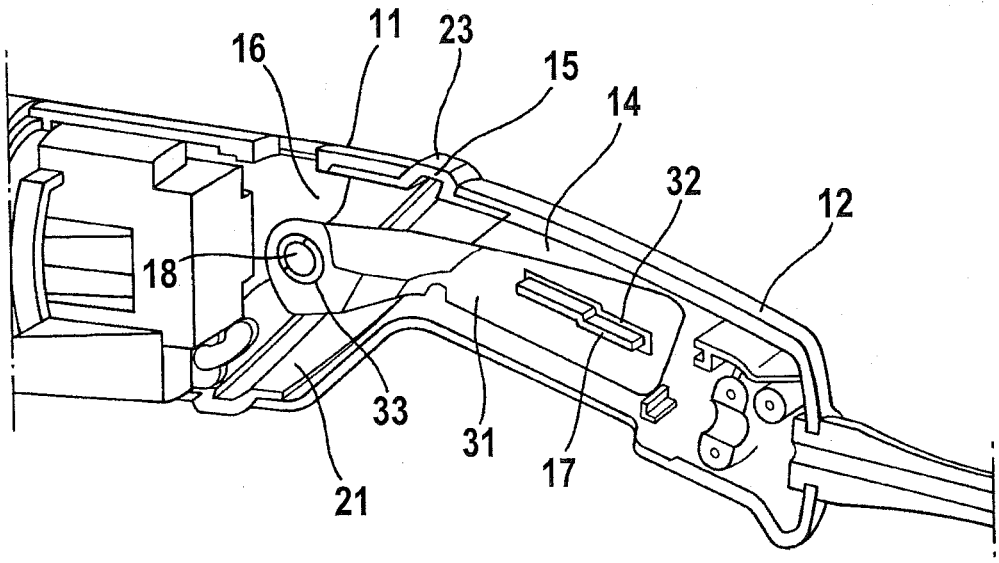
FIG. 2 is a detail of an inside view into the housing of the handheld power tool of FIG. 1, with a first embodiment of a securing element.

The damping element 21 is embodied approximately annularly, so that it extends all the way around in the interstice 15 between the two housing parts 11, 12. In the interstice 15, it has a radially outward-oriented bead 23. As can be seen in FIG. 2, to improve the damping properties the bead is embodied as essentially U-shaped.

In FIG. 2, a securing element 31 in the form of a metal plate is provided, which is placed in the two housing parts 11, 12 that are joined to a damping element 21 and is joined to them. The plate may be flat but is preferably curved, so that it is better adapted to the contour of the housing parts 11, 12. The securing element 31 is fixed in the housing part 12 embodied as a handle via a form lock. To that end, the securing element 31 is provided with openings 32. Pegs 17 that fit into the openings 32 are integrally molded onto the inner wall of the housing part 12 and optionally engage the openings from behind. In addition, the securing element 31 may be secured to the housing parts 11, 12 by adhesive bonding, welding, etc. In the first housing part 11, the connection between the securing element 31 and the housing part 11 has play. A round peg 18 is integrally molded onto the inner wall of the housing part 11, which fits with play into a round opening 33 in the securing element 31. In this embodiment, the securing element 31 is connected to the two housing parts 11, 12, but not to the damping element 21. The securing element 31 merely rests on the damping element 21, or has no contact whatever with the damping element 21.

Unlike what is shown in FIG. 2, instead of a separate component, the securing element may also be integrally molded (not shown) onto one of the two housing halves.

Figure 3:
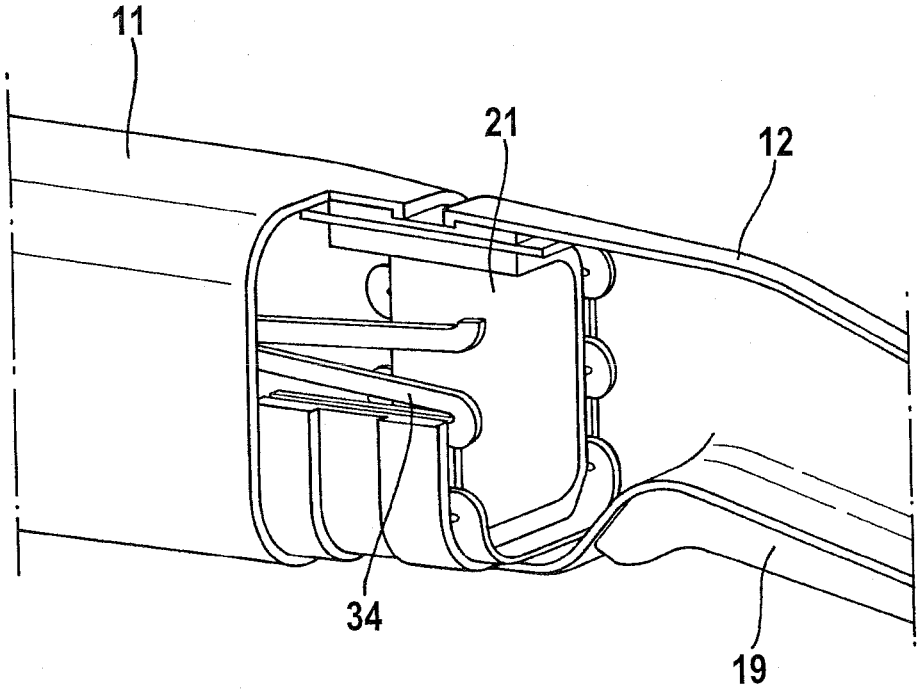
FIG. 3 is a schematic view of a detail of a handheld power tool of the invention, with a further embodiment of a securing element.

In FIG. 3, again unlike FIG. 2, the securing element 34 is connected not only to the two housing parts 11, 12 but also to the damping element 21, which here again comprises an elastic material, in particular an elastomer. Here the securing element 34 takes the form of struts, which may be embedded individually, or joined together, in the damping element 21. For integrally molding the damping element 21 onto the housing parts 11, 12, the securing element 34 can for instance be placed in the cavity of the injection mold and sheathed. The securing element 34 may also be attached to the housing parts 11, 12 additionally in a first step, for instance by means of adhesive bonding or sheathing. Only in a second step is the complete sheathing with the elastic material of the damping element 21 then done.

Figure 4:
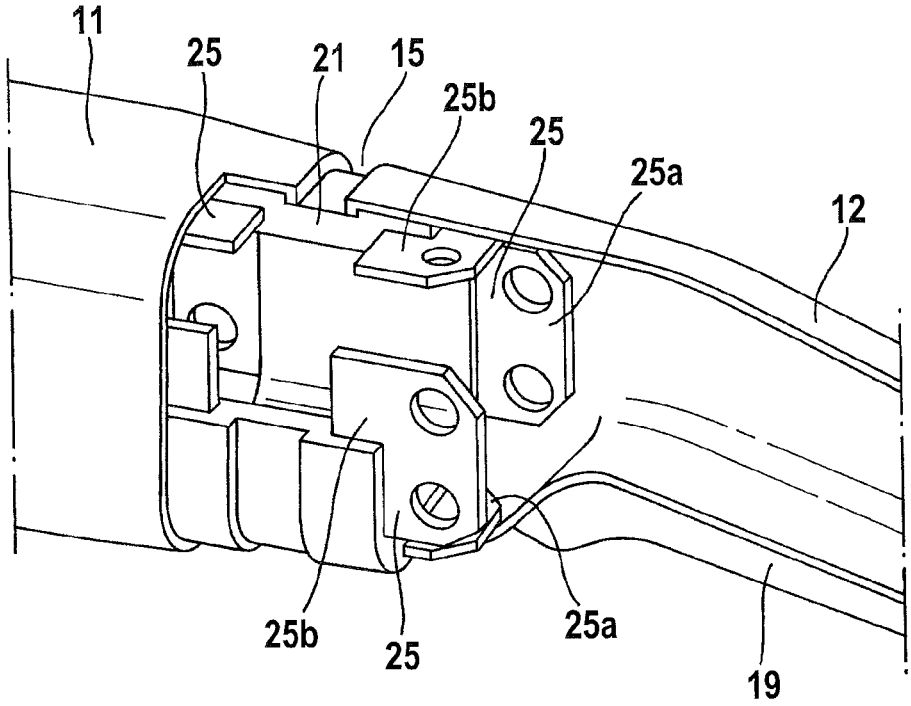
FIG. 4 is a schematic view of a detail of a handheld power tool of the invention, with retaining elements.

In another embodiment shown in FIG. 4, a damping element 21 of an elastic material is likewise provided in the interstice 15 between the first housing part 11 and the second housing part 12. For securely fastening the damping element 21 to the housing parts 11, 12, retaining elements 25 are built into the housing parts 11, 12. The retaining elements 25 may be of metal or plastic.

On the one hand, the retaining elements 25 are each connected to one of the housing parts 11 or 12. On the other, the retaining elements 25 are connected to the damping element 21. The damping element 21 may for instance be molded around the retaining elements 25, so that the retaining elements 25 are embedded in the damping element 21. In the embodiment shown in FIG. 4, the retaining elements 25 comprise a first part 25*a*, which is connected to one housing part, in this case the housing part 12, and an angled second part 25*b*, which is connected to the damping element 21.

Figure 5:
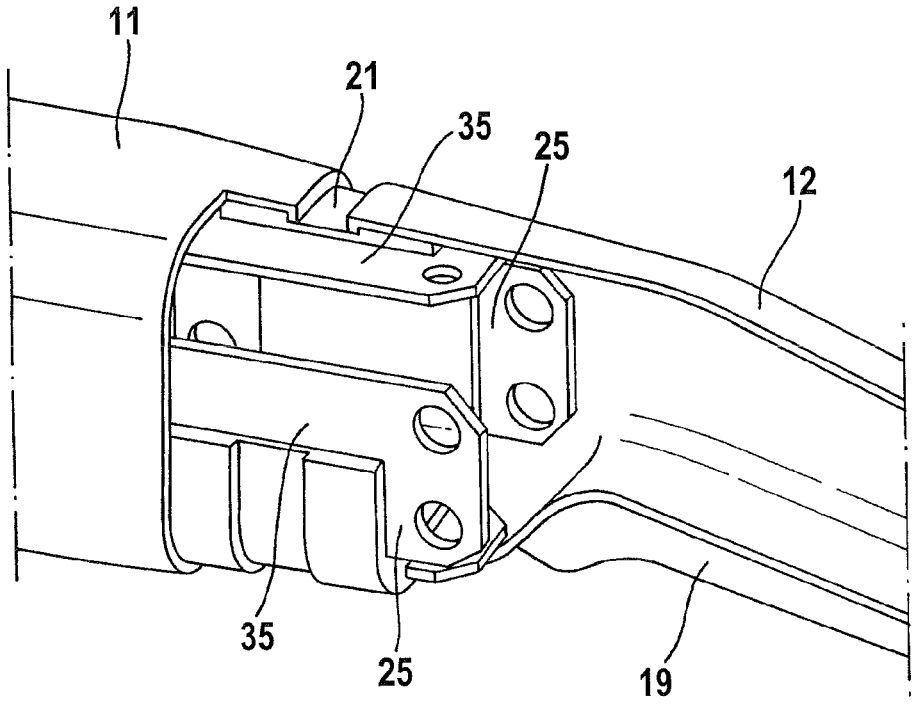
FIG. 5 is a schematic view of a detail of a handheld power tool of the invention, with a further embodiment of a securing element.
Figure 6:
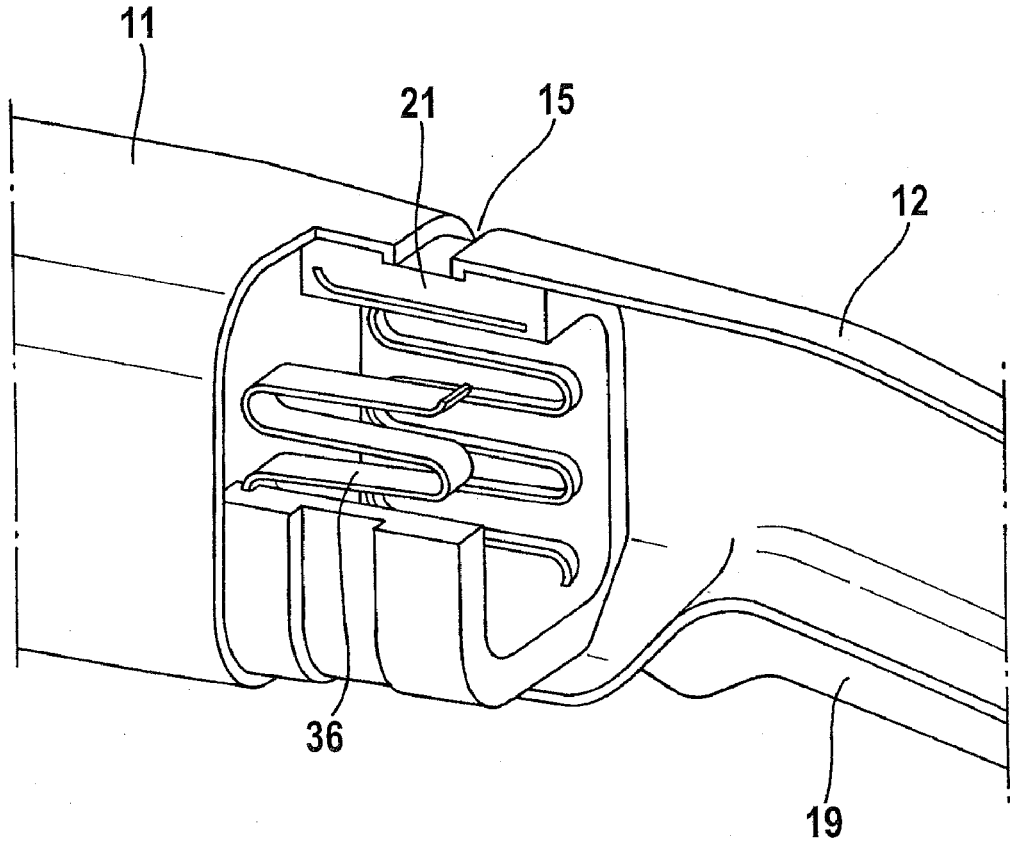
FIG. 6 is a schematic view of a detail of a handheld power tool of the invention, with a further embodiment of a securing element.

In the embodiment of FIG. 5, the securing element 35, which if the damping element 21 should fail assures the connection of the housing parts 11, 12 to one another in the interstice 15 between the housing parts 11, 12, is at the same time a retaining element 25, which assumes the function described above in conjunction with FIG. 4. The securing element 35 is a plate, for instance of metal or plastic, which is embedded in the damping element 21 that comprises an elastic material, such as an elastomer.

In a further embodiment, the securing element 36 is embodied as a spring element, so that the securing element 36 additionally takes on the function of a damping element. The spring element takes the form of a leaf spring and is embodied in wavelike form. The securing element 36 is again embedded in the damping element 21 of elastic material. The securing element 36 is wider than the interstice 15 between the housing parts 11, 12, so that it can bring about an additional connection of the two housing parts 11, 12 to one another.

It will be understood that each of the elements described above, or two or more together, may also find a useful application in other types of constructions differing from the type described above.

While the invention has been illustrated and described as embodied in a handheld power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A handheld power tool, comprising a first housing part and a second housing part spaced from one another overlap-free in a longitudinal direction so as to form an interstice therebetween and movable relative to one another in the longitudinal direction; a single damping element arranged between said first housing part and said second housing part so as to completely fill up the interstice between said first and second housing parts and to extend in said longitudinal direction along said first housing part and said second housing part away from said interstice in opposite directions and integrally molded at least from inside onto inner walls of said first housing part and said second housing part and thereby fixably connected to said first housing part and said second housing part; and at least one securing element extending between said first and said second housing parts transversely to and over said interstice between said first and second housing parts and also along said first housing part and said housing part in the longitudinal direction away from said interstice in two opposite directions.

2. A handheld power tool as defined in claim 1, wherein said damping element comprises an elastic material.

3. A handheld power tool as defined in claim 2, wherein said damping element comprises a thermoplastic elastomer as the elastic material.

4. A handheld power tool as defined in claim 1, wherein said damping element is configured as a profiled damping element.

5. A handheld power tool as defined in claim 4, wherein said damping element is configured as a radially outward-oriented bead.

6. A handheld power tool as defined in claim 1; and further comprising at least one retaining element to which said damping element is connected.

7. A handheld power tool as defined in claim 6, wherein said at least one retaining element is provided in a part selected from the group consisting of said first housing part, said second housing part, and both.

8. A handheld power tool according to claim 1, wherein the securing element is fixed to one of the first housing part and the second housing part.

9. A handheld power tool according to claim 1, wherein the securing element is provided with at least one through-hole.

10. A handheld power tool according to claim 9, wherein an inner wall of one of the first housing part and the second housing part has at least one pin engaging into the at least one through-hole.

11. A handheld power tool according to claim 9, wherein an inner wall of one of the first housing part and the second housing part has at least one pin engaging with play into the at least one through-hole.

12. A handheld power tool according to claim 1, wherein the securing element is fixed with play to at least one of the first housing part and the second housing part.

13. A handheld power tool according to claim 1, wherein the securing element is adapted to an inner contour of the first and second housing parts.

14. A handheld power tool according to claim 1, wherein the securing element has a curved form.

15. A handheld power tool according to claim 1, wherein the securing element is inserted into at least one of the first housing part and the second housing part.

16. A handheld power tool, comprising a first housing part and a second housing part spaced from one another overlap-free in a longitudinal direction so as to form an interstice therebetween and movable relative to one another in the longitudinal direction; a single damping element arranged between said first housing part and said second housing part so as to completely fill up the interstice between said first and second housing parts and to extend in said longitudinal direction along said first housing part and said second housing part away from said interstice in opposite directions and integrally molded at least from inside onto inner walls of said first housing part and said second housing part and thereby fixably connected to said first housing part and said second housing part; and at least one securing element formed as a plate extending between said first and said second housing parts transversely to and over said interstice between said first and second housing parts and also along said first housing part and said housing part in the longitudinal direction away from said interstice in two opposite directions.

17. A handheld power tool according to claim 16, wherein the second housing part is designed as a handle.

* * * * *